US006036399A

United States Patent [19]

Schalk

[11] Patent Number: 6,036,399

[45] Date of Patent: Mar. 14, 2000

[54] CRASH BARRIER AND METHOD OF ERECTING

[75] Inventor: Henri Schalk, Doizieu, France

[73] Assignee: Les Profiles du Centre S.A., France

[21] Appl. No.: 09/142,717

[22] PCT Filed: Mar. 13, 1997

[86] PCT No.: PCT/FR97/00451

§ 371 Date: Sep. 14, 1998

§ 102(e) Date: Sep. 14, 1998

[87] PCT Pub. No.: WO97/35070

PCT Pub. Date: Sep. 25, 1997

[30] Foreign Application Priority Data

Mar. 15, 1996 [FR] France ..... 96 03490

[51] Int. Cl.[7] ..... E01F 13/00; E04H 17/00

[52] U.S. Cl. ..... 404/6; 404/9; 256/13.1

[58] Field of Search ..... 404/6, 9, 10, 11; 256/1, 13.1

[56] References Cited

U.S. PATENT DOCUMENTS

| | | | |
|---|---|---|---|
| 4,330,106 | 5/1982 | Chisolm | 256/13.1 |
| 5,489,162 | 2/1996 | LoCicero | 40/331 |
| 5,613,340 | 3/1997 | Bollaert et al. | 403/375 |

*Primary Examiner*—Eileen A Lillis
*Assistant Examiner*—Raymond W Addie
*Attorney, Agent, or Firm*—Wall Marjama Bilinski & Burr

[57] ABSTRACT

A crash barrier that includes barrier sections that are overlappingly joined in assembly. Each section includes a concave center segment cojoined to upper and lower convex sections. Elongated longitudinally extended studs are punched out of one end of each section within the concave center segment. The studs are arranged to engage receiving slots in the other end of each section to facilitate assembly and alignment of the sections upon vertically disposed posts that are driven into the ground. A special machine for assembling and aligning the sections with the support posts is also disclosed.

8 Claims, 6 Drawing Sheets

CRASH BARRIER AND METHOD OF ERECTING

BACKGROUND OF THE INVENTION

The invention relates to the technical field of civil engineering works and more specifically to the construction and fitting-out of roads such as highways and superhighways. More specifically, the invention relates to a new type of crash barrier installed at the edges of such roads. It also envisages a method and a machine for erecting these barriers.

As is known, expressways and especially superhighways have, on their verges, or at the edge of the carriageway, barriers that form crash barriers. These barriers generally consist of longitudinal elements placed end to end and having a given profile that can tolerate a certain amount of deformation and thus push back toward the center of the carriageway any vehicles which hit them.

These barriers are commonly mounted on vertical supports and are at the same time secured together by means of members passing through holes pierced opposite each other from one barrier to the next. This state of the art can be illustrated by the teaching of patent U.S. Pat. No. 4,330,106 which discloses a crash barrier mounted between two support elements comprising, at each of its ends, an overlapping region which, on the one hand, allows it to be secured to adjacent barriers by means of members of the bolt type passing through holes pierced opposite each other from one barrier to the next and, on the other hand, allows it to be secured to said support elements by means of members passing through the orifices provided opposite each other in the thickness of each barrier.

In general, this type of barrier is erected as follows.

First of all, the barriers are unloaded and laid out on the ground in line with their final location. Next, a support-erecting vehicle, also known as a pile driver, travels along the line and, at each overlap region, drives in a post. Next, two operators lift up the barrier to be erected and mount it on the support.

The next operation consists in securing the newly installed barrier to the previous one, using nut/bolt pairs. A heightwise adjustment then needs to be carried out before the bolts are definitively tightened. It goes without saying that all these operations are particularly troublesome and require a great deal of labor. Furthermore, such barriers are positioned entirely manually and empirically, and this increases the risks of error and the time taken.

The invention has set itself the task of overcoming these drawbacks.

SUMMARY OF THE INVENTION

The problem that the invention sets out to solve is that of improving and making easier, on the one hand, the joining-together of the barriers and, on the other hand, their erection and attachment to the corresponding supports, the objective being to reduce the time needed and to obtain great erection accuracy.

The invention relates, as is known, to a crash barrier intended to be mounted between two support elements fixed into the verges of a highway, and comprising at each of its ends an overlapping region allowing, on the one hand, it to be secured to the adjacent crash barriers by means of members that pass through pierced holes which are opposite each other from one crash barrier to the next and, on the other hand, it to be secured to the support elements by means of members passing through orifices provided opposite each other for this purpose in each crash barrier.

In order to solve the set problem of joining the barriers together, each barrier is one wherein one of the overlapping regions comprises at least one stud oriented along the longitudinal axis of the crash barrier toward the middle thereof, and wherein the other region comprises, on the generatrix that receives the stud, a slot intended to receive the stud of the adjacent crash barrier.

In other words, the barriers have engaging parts which positively attach one barrier to another.

To make these engaging parts easier to produce, the studs are lanced parts obtained by cutting the sheet metal of the barrier. It is thereby unnecessary to add extra material.

Given the mechanical stresses that have to be withstood when the barriers are being erected, the studs advantageously have a bend along their axis of symmetry, parallel to the longitudinal axis of the barrier. This arrangement improves the rigidity and strength of the studs, while at the same time reducing their width and therefore making them easier to introduce into the complementary holes.

In a particular embodiment in which the barrier has a profile that combines two lateral convex contours connected by a central concave contour, each region has four studs arranged in a rectangle on the concave contour.

In an advantageous embodiment, the diameters of the holes facing each other from one barrier to the next differ, to allow them to be connected using tapering bolts. The use of such self-tapping bolts reduces the number of parts to be used and the time taken.

To solve the set problem of making the barriers easier to erect and to attach to the corresponding supports, a method for erecting barriers in accordance with the aforementioned arrangements has been conceived and developed.

This method consists, having set a first barrier down on the ground, and continuously, in:

- engaging the studs of the first barrier in the complementary slots of the next barrier;
- exerting a tensile force on the next barrier in order to engage the studs and form a run of barriers;
- pivoting the run obtained to stand it vertically in the position for erection on the supports;
- automatically detecting in the run of barriers the orifices for securing to the supports;
- driving a support into the ground at the detected point;
- automatically checking the depth to which the support has been driven by stopping driving as soon as it is detected that the orifice of the barriers is aligned with a corresponding hole of the support;
- securing the barriers to the support.

In that way, unlike in the prior art, and by virtue of the presence of the characteristic studs, the barriers are pre-secured before they are placed on the supports. This allows the siting of the supports and the fitting of the run of pre-secured barriers to be automated.

The invention also relates to a machine for implementing the above-described method.

This machine is one which comprises, on a mobile chassis:

- means for continuously lifting the run of barriers secured by the studs and placing it in a vertical orientation,
- first means for detecting, on the run of barriers, the orifices for securing to the supports;
- means for driving in a post, these means being connected to the detection means and controlled by said detection means;

second means for detecting the driving of the supports, these means being connected to the driving means and controlling the driving means.

Advantageously and in practice, the means for orienting the run of barriers consist of a series of rollers located at the front of the machine, in the direction of forward travel thereof.

In a preferred embodiment, the first and second detection means are coincident and consist of:

an optical-beam emitter situated on the chassis of the machine and emitting its beam in a direction at right angles to the direction of travel of the machine, and at a height that corresponds to the height at which the barriers are to be attached, an optical detector placed on an extension of the machine on the other side of the intended location of the barrier and capable of receiving the optical beam through the orifices in the run of barriers and through the orifices in the support.

In other words, after it has been rotated, the run of barriers passes in front of a beam of light emitted by a device provided for this purpose on the chassis. When the ray of light passes through the orifice intended for attachment to the support, this beam of light is received by a detector which orders the chassis to stop at the precise point where the support is to be fixed. Combined with this, when the support reaches a certain depth, the slot it has for receiving the member for connection to the barrier allows the beam of light through, and this gives the order to stop the driving member.

In a preferred embodiment, the means for driving in the support consist of a hammer that can move along a vertical axis, and the head of which has a shape that envelopes the top end of a support, this hammer being associated with a bottom bracket for guiding and positioning the bottom end of the same support.

BRIEF DESCRIPTION OF THE DRAWINGS

The way in which the invention is achieved, and the advantages which stem therefrom will emerge clearly from the remainder of the description of the embodiment which follows, in support of the appended figures, in which.

DESCRIPTION OF THE INVENTION

Figure 1:
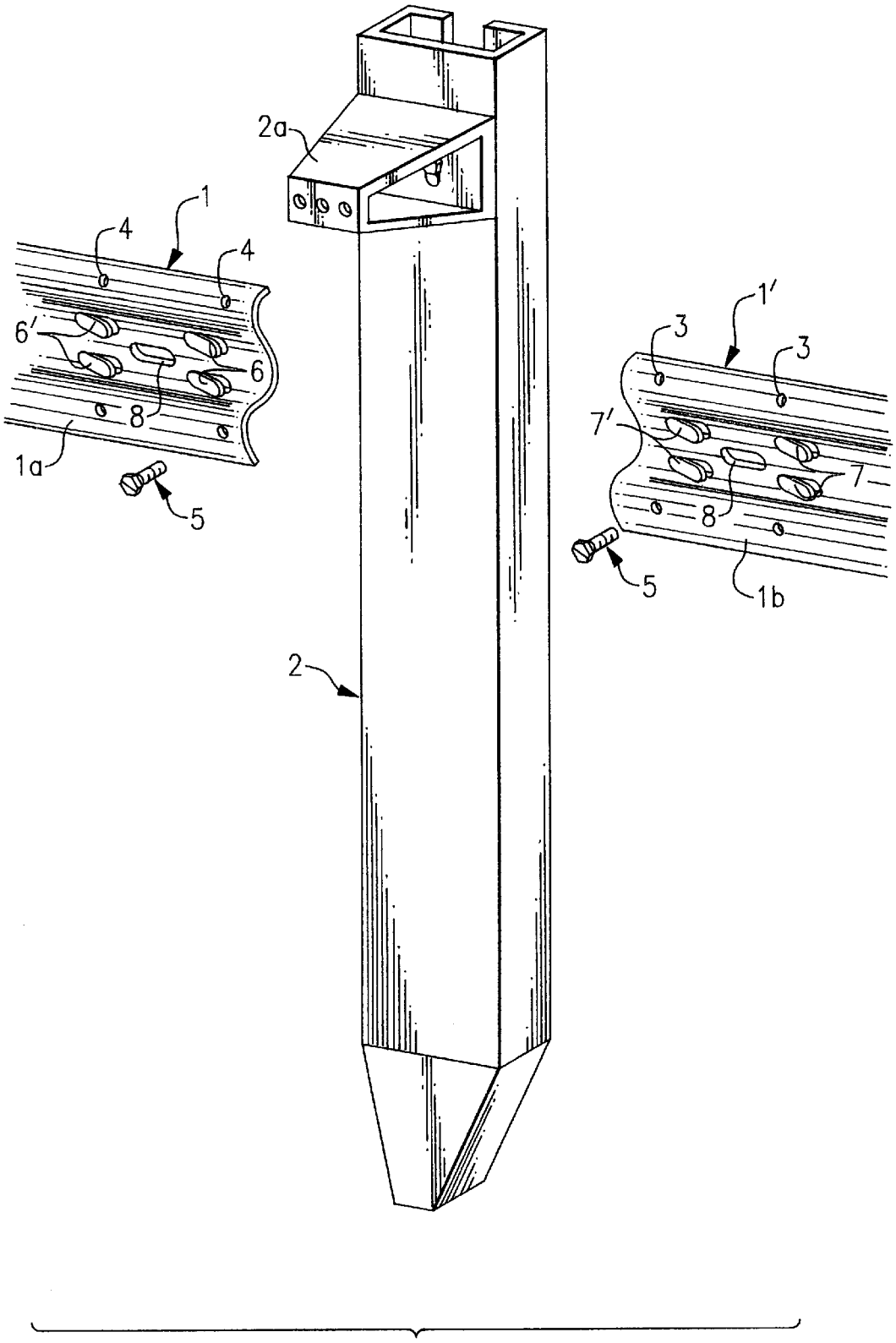
FIG. 1 is a succinct perspective view of the barrier elements in accordance with the invention, before mounting on the supports.

As already stated, the invention relates in particular to the arrangement of the overlapping regions (1*a,* 1*b*) of crash barriers (1). In general, a barrier (1) consists of a profiled metal section piece mounted between two supports (2) fixed into the ground (FIG. 1). In the nonlimiting embodiment depicted, this section piece is made up of two convex lateral portions (1*c,* 1*d*) connected by a concave central portion (1*e*).

Figure 3:
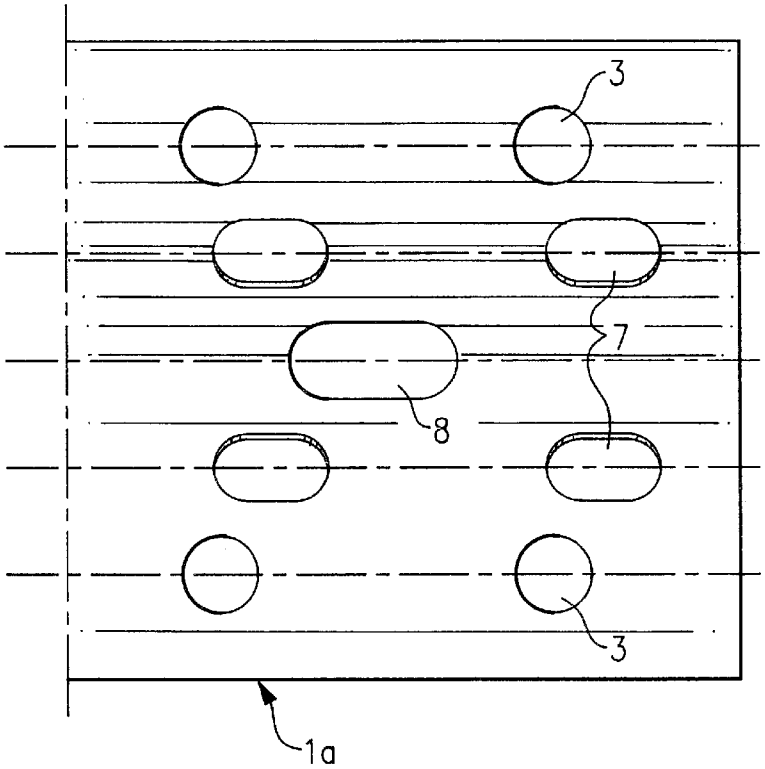
FIGS. 2 and 3 are front views of the two overlapping regions of a barrier.
Figure 2:
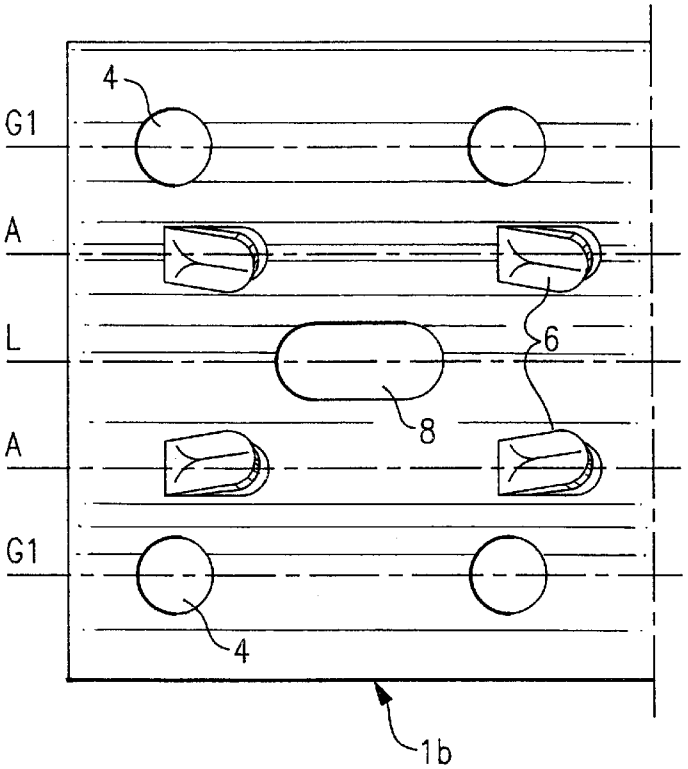
Figure 4:
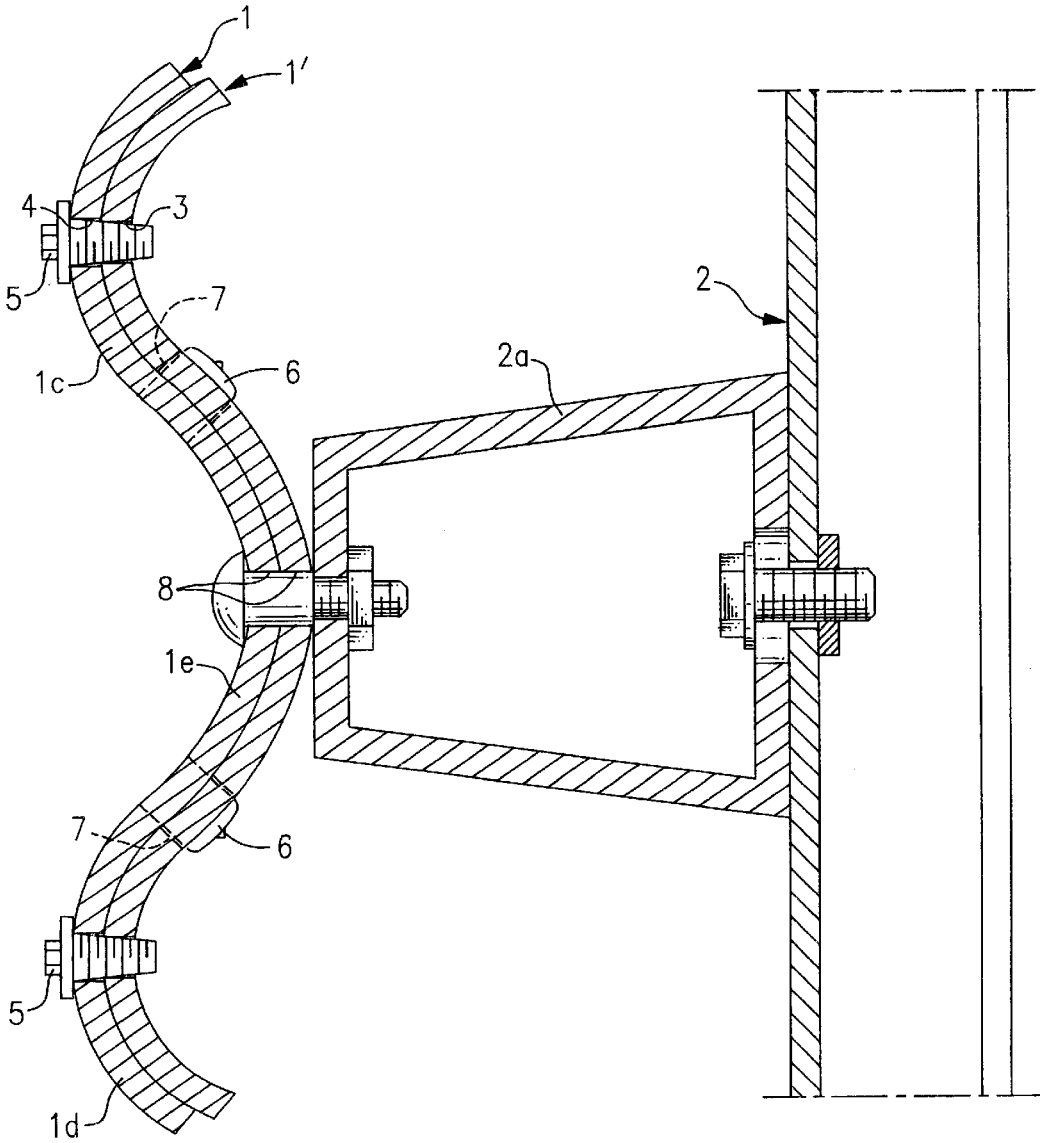
FIG. 4 is a sectional view through the overlapping region of two barriers at the location of the members for joining the barriers together.

On the outside of the convex portions (1*c,* 1*d*) of one end (1*a*), the barrier (1) has a number of holes (3) arranged along one and the same generatrix (G1) (FIG. 2). At the opposite end (1*b*) of the barrier, and on the same generatrices (G1), there are also a number of pierced holes (4) identically spaced that can be superimposed with the first ones (3) (FIG. 3). According to one feature of the invention, at an overlap, the holes (4) of the barrier that is situated on the carriageway side are of a slightly larger diameter than those (3) of the barrier closest to the verge. This arrangement allows the two barriers (1, 1') to be screwed together using self-tapping tapering bolts (5), thus avoiding the use of a nut.

Another essential feature of the invention lies in the fact that there are studs (6) in the overlapping region (1*a*) . More specifically, these studs (6) are located in the concave portion (1*e*) of the barrier (FIG. 2). These studs (6) are obtained by cutting the sheet metal of the barrier and by deforming the cut tabs inward. These tabs (6) have a longitudinal axis (A) parallel to the longitudinal axis (L) of the barrier, and are oriented toward the middle of the barrier. To complement these, and therefore on the same generatrices, the opposite end of the barrier has holes (7) that can be superposed with the studs (6).

Figure 5:
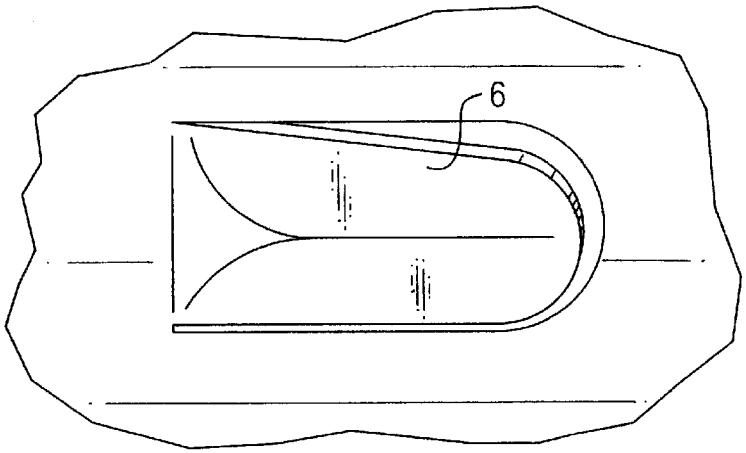
FIG. 5 is a view from above of a stud.
Figure 6:
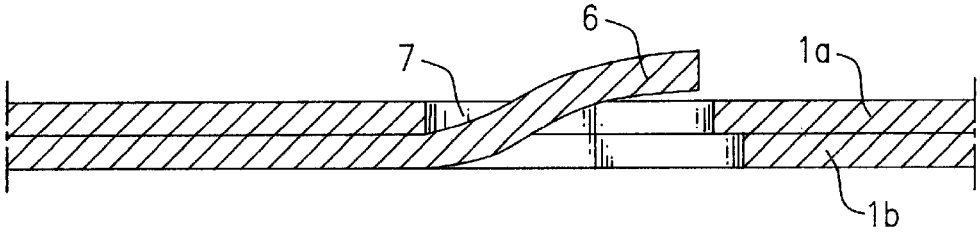
FIG. 6 is a view from above, in longitudinal section, at the location of the stud-attachment region, of two barriers joined together.

As illustrated in FIG. 5, each stud (6) is bent slightly along its longitudinal axis (A) to improve its strength and reduce its width, and thus make it easier to fit into the complementary hole (7). Thus, as illustrated in FIG. 6, the attachment of the stud (6) becomes more secure.

Furthermore, the central part of the concave part (1*e*) is pierced with an orifice (8) intended to receive the member for securing to the support (2). In a known way, this orifice (8) is slightly oblong to allow positional compensation when the barrier (1) is fitted to the support (2).

Of course, the invention is not restricted to the illustrated number and arrangement of studs and holes, but on the contrary covers all envisageable alternative versions.

Furthermore, the invention also relates to a method for erecting such barriers. Thus, the presence of studs makes these barriers easier to erect.

Figure 7:
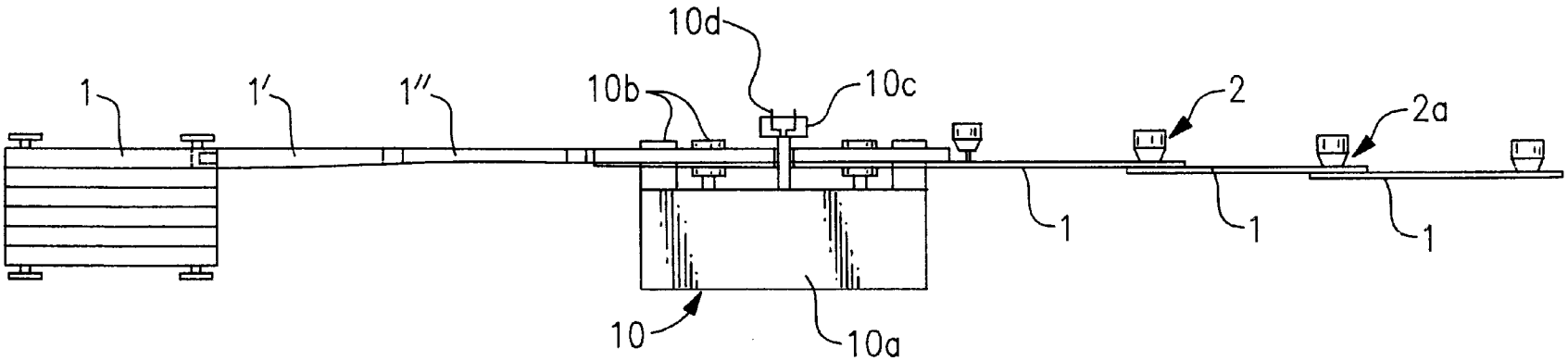
FIG. 7 is a diagrammatic view from above showing the erection of the barriers in accordance with the invention.

As illustrated diagrammatically in FIG. 7, the method in accordance with the invention consists in laying a succession of barriers (1, 1', 1", . . . ) out along the carriageway. It is important that these barriers be laid out with the studs (6) of the current barrier (1) engaged in the complementary holes (7) of the previous barrier (1') already laid out. Thus, a run of pre-secured barriers is created.

At the same time, and after a few lengths of barrier, the run obtained is lifted up, this producing a tensile force on the overlapping regions (1*a*–1*b*) and engaging the studs (6) cleanly in the holes (7) Note that this maneuver is possible by virtue of the special structure of the barrier (1) and cannot be performed on barriers of the prior art.

At the same time, the run (1, 1', 1", . . . ) of barriers is twisted to pivot it into a vertical configuration, that is to say bring it into the orientation ready for erecting. At the same time, traveling along the run of barriers, the position of the oblong orifices (8) in the overlapping regions (1*a,* 1*b*) is automatically detected. A support (2) is driven in at the points thus detected. At the same time, the depth of driving is checked and when the slot (2*a*) in the support coincides with the orifice in the barrier (8), driving is stopped. All that then remains is for the run of barriers to be fixed to the driven-in support.

Such a method can be implemented by virtue of a characteristic machine (10) of the invention.

This machine is therefore made up of a self-propelled chassis (10*a*) which is conventional and not described in detail here.

This chassis (10*a*) receives, in its front part and to the side, a set of rollers (10*b*) which force the run of barriers to move from a horizontal or laid-out flat orientation, into a vertical orientation.

Furthermore, this machine comprises a driving device (10*c*) offset to one side of the chassis (10*a*). This driving device is made up mainly of a hammer (or ram) (10*c*1) mounted on a vertical axis (10*c*2). That part of the hammer (10*c*1) that is intended to come into contact with the support (2) is enveloping, that is to say covers the top end of the support and allows the support to be kept vertical, preventing it from tilting. To complement this, the bottom part of the driving assembly comprises a guide bracket (10*d*) intended to hold the bottom end of the support (2) at the start of driving. This bracket (10*d*) may have the approximate shape of a horseshoe open toward the back in the direction of travel of the chassis.

Furthermore, the chassis (10*a*) comprises optical guidance elements (10*e*) allowing the supports to be erected at optimum positions and heights.

Thus, these guide elements consist of a light unit (10*e*1) emitting a focused optical beam (F). The direction of this beam (F) is perpendicular to the plane formed by the various supports (2) already driven in. The height of this plane is very exactly the height at which the point (8) for securing the barrier to the support (2) is to be found. The optical unit (10*e*1) as associated with a reflector (10*e*2) arranged on an arm extending the chassis (10*a*1), on the other side of the final location of the barrier (1).

The way in which the machine in accordance with the invention operates is as follows.

Figure 8:
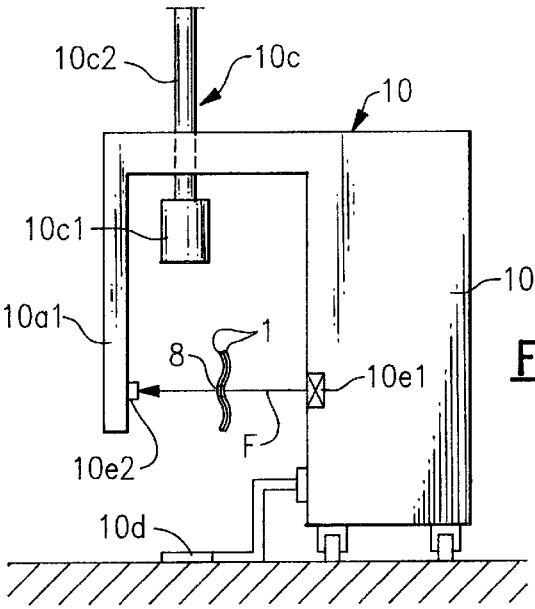
FIGS. 8 to 10 are diagrammatic side views of a barrier laying machine, in various phases of the erecting of a support.

When the run of barriers (1, 1', 1") passes in front of the light box (10*e*1), the beam (F) is scattered by the metal of the barriers (2), until an orifice (8) comes in front of the beam (FIG. 8). At this moment, the beam (F) passes through the barrier (2) and will be reflected off the reflector (10*e*2) (FIG. 8). This corresponds to the location where a support (2) needs to be driven in.

Figure 9:
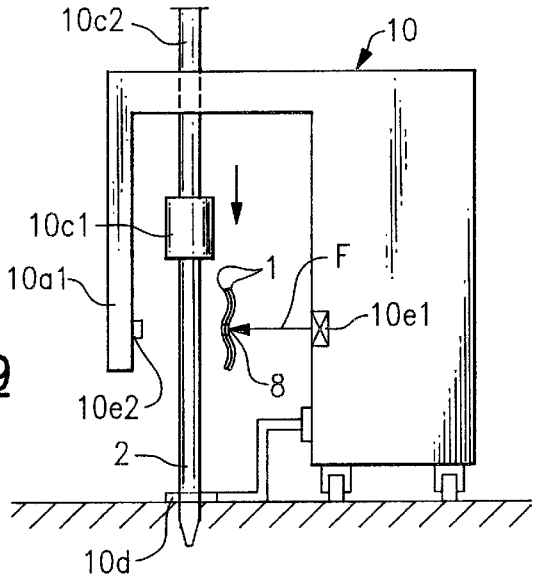

A support (2) is then introduced into the bracket (10*d*) and the driving device (10*c*) is then actuated. As the support (2) is driven in, the attachment slot (2*a*) is caused to move downward (FIG. 9).

Figure 10:
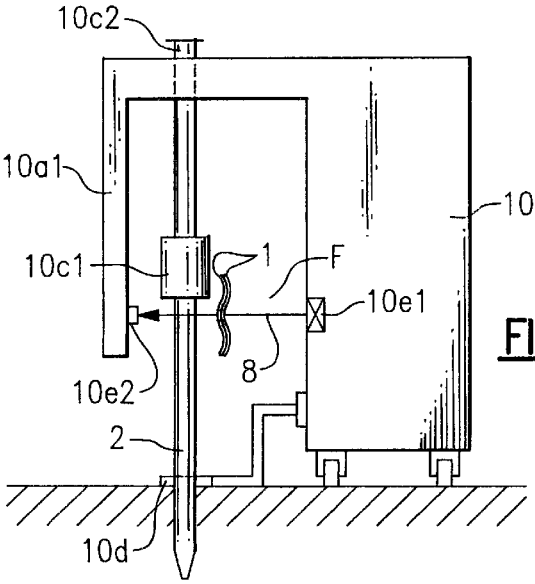

At a given instant, this slot comes opposite the oblong orifice (8) in the barrier and the ray of light (F) passes through it. Detection of this ray (F) by the reflector (10*e*2) gives the signal to stop driving (FIG. 10). The depth to which the support (2) is driven then corresponds exactly to the anticipated barrier height. All that then remains is for the run of barriers (1, 1', 1", . . . ) to be secured to this support (2).

It is clear from the foregoing that the barriers in accordance with the invention, together with the erection method and machine designed for this purpose, make the erection of crash barriers far easier, avoiding the troublesome tasks, limiting the labor required, and automating the handling operations which previously were performed entirely by hand. Furthermore, the use of automatic means improves the accuracy of positioning and eliminates any adjustment after the actual erection.

What is claimed is:

1. A crash barrier that includes:

longitudinal barrier sections that are arranged so that one end section of a first barrier section overlaps the other end of a second adjacent barrier section to establish overlapping regions between adjacent barrier sections, a first interlocking means for connecting one end section of a first barrier section to an opposite end section of a second adjacent barrier section, said interlocking means further including an elongated longitudinally disposed stud that is integrally formed in the overlapping region of said first barrier section and is slidably received within a slot formed in the overlapping region of said second adjacent barrier section to lock adjacent sections together in assembly, fastening means in each overlapping region to further secure the adjacent barrier sections together in assembly, and vertically disposed support elements connected to the barrier in each overlapping region.

2. The crash barrier of claim 1 wherein the studs are punched out at one end of each barrier section.

3. The crash barrier of claim 2 wherein said studs are each bent arcuately about a longitudinal axis that is parallel with the axial centerline of the barrier section.

4. The crash barrier of claim 1 wherein each barrier section includes a central concave segment cojoined to convex upper and lower segments, said studs being located upon the concave segment of each barrier section.

5. The crash barrier of claim 4 wherein each barrier section contains four studs arranged in a rectangular pattern about the axial centerline of the section.

6. The crash barrier of claim 1 wherein said connecting means further include a series of aligned holes in the overlapping regions of the barrier sections and a tapered bolt threaded into each pair of aligned holes to connect the sections in assembly.

7. The crash barrier of claim 1 wherein said joining means is a threaded fastener that secure the overlapping region of said barrier sections with a vertically disposed support element mounted in the ground along a carriage-way.

8. A method of erecting a crash barrier that includes the steps of integrally forming an elongated longitudinally disposed stud in one end of each barrier section and a slotted hole in the opposite end of each barrier section, placing a first barrier section flat upon the ground and a second barrier section on top of the first barrier section so that one end of a first section overlaps the opposite end of the next adjacent section, inserting the stud of each first section into the slot of each second section and exerting a force on the adjacent sections to interlock the adjacent sections together to form a connected run of sections, raising the sections of a run into a vertical plane and positioning the overlapping regions of adjacent sections on spaced apart vertical supports, driving the supports into the ground and checking the depth of each support, detecting automatically when a mounting hole formed in each overlapping region is aligned with a receiving hole in a vertical support, and securing each overlapping region to a support by mounting a fastener in each aligned hole.

* * * * *